US007117764B2

(12) United States Patent
Garric

(10) Patent No.: US 7,117,764 B2
(45) Date of Patent: Oct. 10, 2006

(54) SCREWED DEVICE TIGHTENING/UNTIGHTENING TOOL

(75) Inventor: Stephane Garric, Balma (FR)

(73) Assignee: Airbus France, Toulouse (FR)

( * ) Notice: Subject to any disclaimer, the term of this patent is extended or adjusted under 35 U.S.C. 154(b) by 102 days.

(21) Appl. No.: 10/898,353

(22) Filed: Jul. 26, 2004

(65) Prior Publication Data

US 2005/0034567 A1 Feb. 17, 2005

(30) Foreign Application Priority Data

Aug. 13, 2003 (FR) ..... 03 50429

(51) Int. Cl.
*B24B 13/46* (2006.01)

(52) U.S. Cl. ..... 81/57.39; 81/57.44

(58) Field of Classification Search ..... 81/57.24, 81/57.39, 57.44
See application file for complete search history.

(56) References Cited

U.S. PATENT DOCUMENTS

| | | | | |
|---|---|---|---|---|
| 2,961,904 | A | 11/1960 | Sergan | |
| 3,719,112 | A | 3/1973 | Kaelon | |
| 3,955,447 | A * | 5/1976 | Parker | 81/57.39 |
| 4,086,830 | A * | 5/1978 | Latham | 81/57.39 |
| 4,325,274 | A * | 4/1982 | Martelee | 81/57.13 |
| 4,385,533 | A * | 5/1983 | Collins | 81/57.39 |
| 4,409,865 | A * | 10/1983 | Krautter et al. | 81/57.39 |
| 4,446,762 | A * | 5/1984 | Junkers | 81/57.39 |
| 4,448,096 | A * | 5/1984 | Collins | 81/57.39 |
| 4,480,510 | A * | 11/1984 | Aparicio et al. | 81/57.39 |
| 4,513,645 | A * | 4/1985 | Grabovac et al. | 81/57.39 |
| 4,706,527 | A * | 11/1987 | Junkers | 81/57.39 |
| 4,794,825 | A * | 1/1989 | Schmoyer | 81/57.39 |
| 4,794,826 | A * | 1/1989 | Franks | 81/57.39 |
| 4,854,197 | A * | 8/1989 | Walton | 81/57.39 |
| 4,919,018 | A * | 4/1990 | Beuke | 81/57.39 |
| 4,974,476 | A * | 12/1990 | Junkers | 81/57.39 |
| 4,982,626 | A * | 1/1991 | More et al. | 81/57.39 |
| 5,016,502 | A * | 5/1991 | Junkers | 81/57.39 |
| RE33,951 | E * | 6/1992 | Junkers | 81/57.39 |
| 5,139,092 | A | 8/1992 | Boyle | |
| 5,142,951 | A * | 9/1992 | Walton | 81/57.39 |
| 5,201,256 | A * | 4/1993 | Schneider et al. | 81/57.34 |
| 5,203,238 | A * | 4/1993 | Ferguson | 81/57.39 |
| 5,249,486 | A * | 10/1993 | Thompson et al. | 81/57.39 |
| 5,301,574 | A * | 4/1994 | Knopp et al. | 81/57.39 |
| 5,373,759 | A | 12/1994 | Sergan | |
| 5,782,158 | A | 7/1998 | Rothering | |
| 5,792,967 | A | 8/1998 | Steber et al. | |
| 6,029,546 | A * | 2/2000 | Gibson et al. | 81/57.44 |
| 6,289,770 | B1 | 9/2001 | Collins | |
| 6,408,720 | B1 * | 6/2002 | Collins et al. | 81/57.39 |
| 6,912,933 | B1 * | 7/2005 | Knopp et al. | 81/57.39 |
| 2002/0073808 | A1 * | 6/2002 | Jamra et al. | 81/57.39 |

(Continued)

FOREIGN PATENT DOCUMENTS

| | | |
|---|---|---|
| DE | 25 00 679 | 7/1976 |

(Continued)

*Primary Examiner*—David B. Thomas
(74) *Attorney, Agent, or Firm*—Oblon, Spivak, McClelland, Maier & Neustadt, P.C.

(57) ABSTRACT

A tool for tightening and untightening screwed devices, such as bolts for fixing engines (10) to struts (12) on aircraft, comprises a hydraulic wrench (20), a hydraulic pump (22), preferably manual, at a distance from the wrench, and a tube (24) connecting the pump (22) to the wrench (20). The tool also comprises a force resistance structure (26) that transmits wrench reaction forces to an adjacent part, such as the strut (12).

8 Claims, 2 Drawing Sheets

U.S. PATENT DOCUMENTS

| | | | | |
|---|---|---|---|---|
| 2003/0131691 | A1* | 7/2003 | Spirer | 81/57.39 |
| 2003/0136229 | A1* | 7/2003 | Junkers | 81/57.39 |
| 2005/0011313 | A1* | 1/2005 | Spirer | 81/57.39 |

FOREIGN PATENT DOCUMENTS

| | | | |
|---|---|---|---|
| EP | 1 151 826 | | 11/2001 |
| FR | 2 710 575 | | 4/1995 |
| JP | 2003003524 | * | 1/2003 |

* cited by examiner

SCREWED DEVICE TIGHTENING/UNTIGHTENING TOOL

DESCRIPTION

1. Technical Domain

The invention relates to a tool for tightening and loosening screwed devices such as bolts.

In particular, this type of tool may be used for assembly and disassembly of an aircraft engine, by screwing or unscrewing screwed fastening devices used to fasten the engine to the strut connecting the engine to the aircraft structure.

2. State of Prior Art

Aircraft engines are fixed under the wing by means of a strut fixed to the said wing. More precisely, the engine is fixed under the strut by attachment devices designed to transmit forces from the engine to the aircraft structure. Thus, the engine is connected to the strut by screwed fastening devices such as bolts, that form an integral part of the fastening devices.

The engine needs to be removed and then put back into place during some maintenance operations. These operations involve unscrewing and then rescrewing the screwed fastening devices forming part of the attachment systems. Engine cowls need to be opened to access these screwed fastening devices, and appropriate tools have to be used to hold these cowls in the open position.

The engine is removed and put back into place using a standard mechanical torque wrench, provided with a handle that is usually between 0.8 m and 1 m long. The tightening torque of the bolts that connect the engine to the strut is usually between 60 daN.m and 90 daN.m. Consequently, application of the required torque necessitates cooperative work on the handle of the same wrench by two or three operators.

To perform this operation, the operators are positioned under the cowls, on an elevating platform or on the engine bearer, at a height varying between 1.5 m and about 5 m depending on the aircraft. Since the available space between the open cowls and the engine itself is very tight, operators often have to adopt acrobatic and dangerous positions so that each can have a hand on the wrench.

Furthermore, this operation is repeated on every bolt of the attachment systems connecting the engine to the strut, in other words 16 to 20 times for every engine removal and for every engine replacement operation.

Therefore, engine removal and replacement operations introduce serious risks for operators and for the different parts of the aircraft.

Thus, as we have just seen, operators need to adopt dangerous positions above the ground. If the wrench escapes from the bolt head suddenly, operators can fall or suffer from face injuries due to the sudden movement of the wrench.

Moreover, some parts may be damaged by the operators themselves due to the position that they occupy when they perform screwing and unscrewing operations. Operators then apply pressure on the inside of the cowls to find a satisfactory position and sufficient support.

Some parts of the aircraft may also be damaged by the wrench during unscrewing. Thus, since the tightening torque is very high, the wrench starts to turn suddenly when the screw starts to loosen.

Finally, when the wrench escapes from the bolt head, injuries to the operators may be accompanied by damage to some parts of the aircraft.

PRESENTATION OF THE INVENTION

The purpose of the invention is precisely to propose a tool with an innovative design capable of at least partly solving the problems that arise as a result of screwing and unscrewing screwed devices located in difficult-to-access locations and for which a very high torque has to be applied.

Another purpose of the invention is to propose a tool with an innovative design that is capable at least partly solving the problems that arise as a result of screwing and unscrewing bolts fitted on attachment systems connecting engines to struts on aircraft.

According to the invention, these purposes are achieved by means of a tool for tightening and untightening screwed devices, characterized in that it comprises a hydraulic wrench, a hydraulic pump at a distance from the hydraulic wrench, a tube connecting the hydraulic wrench to the pump and a force resistance structure capable of transmitting wrench reaction forces to a part adjacent to the screwed devices, in which the force resistance structure comprises a connecting part that can be fixed to the said adjacent part and a reaction arm on which the wrench can be fitted.

With this arrangement, it becomes possible to tighten and untighten screwed devices remotely, by activating the hydraulic pump at some distance from the said devices. A single operator can set up the force resistance structure and the hydraulic wrench under optimum conditions. The manual hydraulic pump is then used with no risk for the operator or for aircraft parts.

Advantageously, the tool according to the invention is adapted to tightening and loosening screwed fastening devices connecting an aircraft engine to a strut in which the force resistance structure can be fixed to the mast, close to the screwed fastening devices.

In the preferred embodiment of the invention, the hydraulic pump is a manual pump.

BRIEF DESCRIPTION OF THE DRAWINGS

We will now describe one preferred embodiment of the invention as a non-limitative example with reference to the attached drawings in which.

DETAILED PRESENTATION OF A PARTICULAR EMBODIMENT

Figure 1:
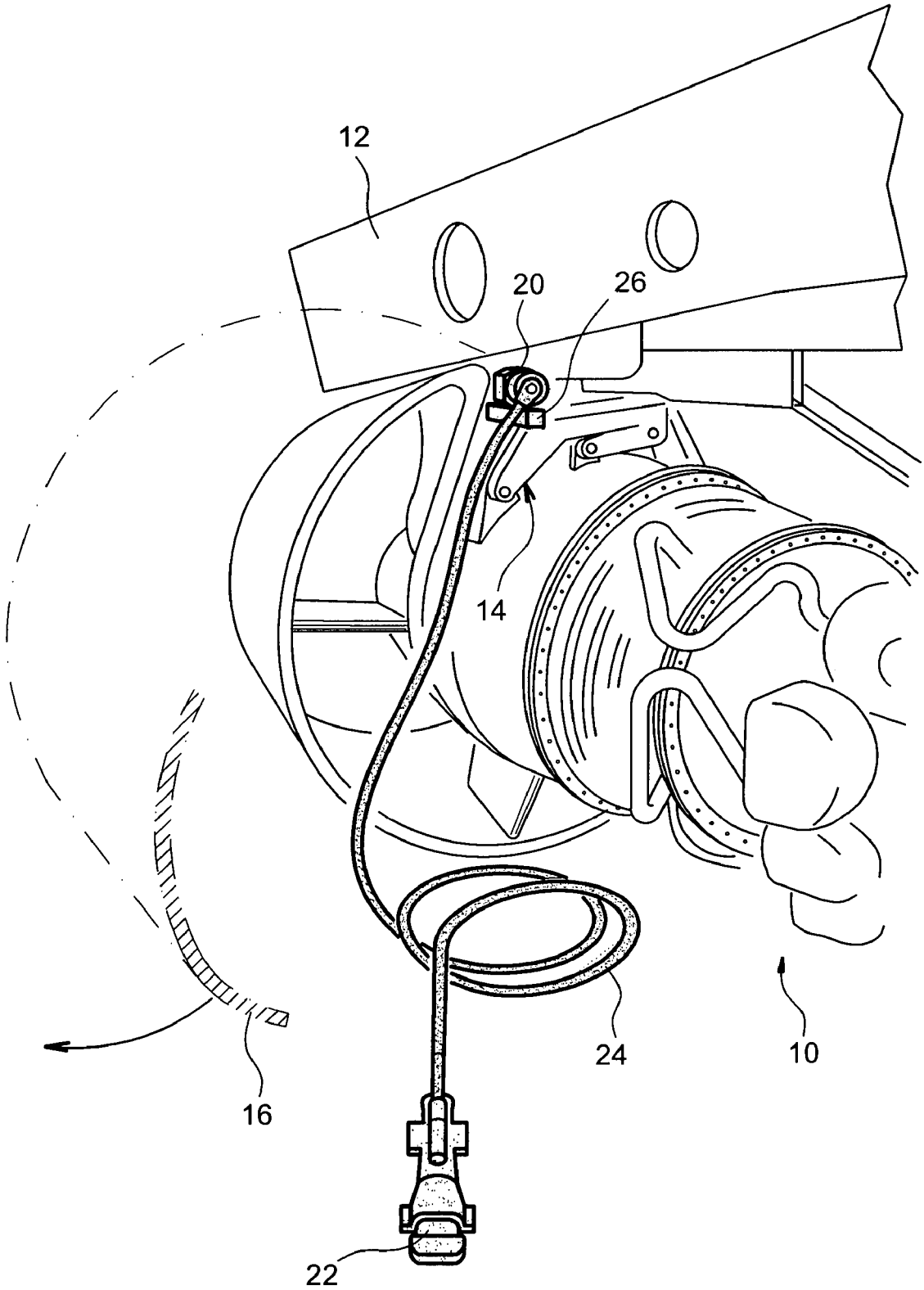
FIG. 1 is an overall perspective view of a tool complying with the invention used for tightening and untightening fastening devices for an attachment system connecting an aircraft engine to a strut.

FIG. 1 diagrammatically shows an aircraft engine 10 suspended from the wing of an aircraft through a strut 12. More precisely, the engine 10 is fixed under the strut 12 by attachment systems, one of which is shown as 14 in FIGS. 1 and 2.

Attachment systems such as the device 14 are accessed by opening the cowls of the engine 10. One of these cowls is shown as 16 in FIG. 1. Normally, an aircraft engine comprises four cowls that are approximately semi-circular as seen in a transverse section through the engine. These cowls include two front cowls around the fan and two back cowls around the thrust invertors. The cowls are held in the open position by a conventional tool, well known to an expert in the subject. This tool is not included in the invention.

Figure 2:
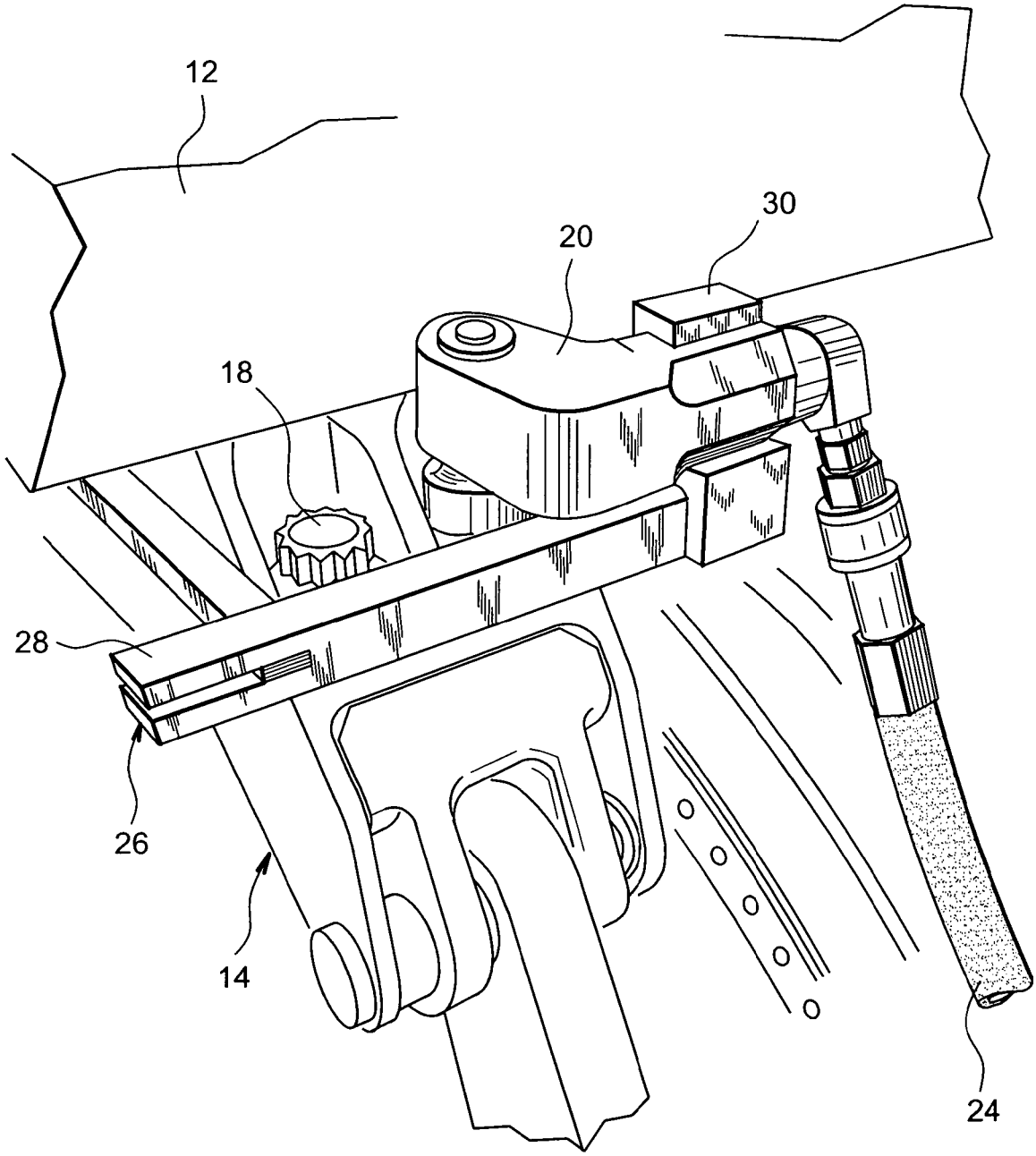
FIG. 2 is a perspective view that shows the hydraulic wrench and the force resistance structure of the tool in FIG. 1 at larger scale.

As illustrated more precisely in FIG. 2, each of the attachment systems 14 comprises screwed devices such as bolts 18, that fix the engine 10 to the strut 12.

During some maintenance operations such as replacement of an engine, the engine to be replaced has to be removed before a new engine can be installed.

According to the invention, these operations are carried out using an innovative tool capable of applying high tightening torques (normally 60 daN.m to 90 daN.m) required for the bolts 18, without any risk of injury for the operators or damage to engine parts.

As illustrated diagrammatically in FIG. 1, the tool according to the invention comprises a hydraulic wrench 20, a manual hydraulic pump 22, a tube 24 connecting the pump 22 to the wrench 20 and a force resistance structure 26.

The wrench 20 is a standard hydraulic wrench for which the characteristics are chosen particularly taking account of the value of the torque to be applied and the available space under the cowls, close to the fastening devices 14. Thus, the wrench 20 is capable of applying a tightening and untightening torque usually between 60 daN.m and 90 daN.m and it is inscribed within a 130 mm×60 mm×60 mm parallelepiped. The weight of such a hydraulic wrench does not exceed 2 kg, and its precision is 3% with a repetitiveness of 1%.

The manual hydraulic pump 22 is also standard. It is located at a distance from the hydraulic wrench 20, at a location such that a single operator can operate the pump 22 without being hindered by engine parts, such as the cowls 16.

Thus, the pump 22 may in particular be placed on the ground or on a table or any other suitable receptacle, outside the area located between the cowls and the central part of the engine 10. This arrangement is made possible by the use of a relatively long tube 24 to make the hydraulic connection between the pump 22 and the wrench 20.

The force resistance structure 26 is designed to resist the high forces exerted by the hydraulic wrench 20 on the head of the fastening bolts 18. Consequently, the force resistance structure 26 includes a connecting part 28 that can be fixed onto a fixed part adjacent to the bolt 18, and a reaction arm 30 on which the wrench 20 is fitted.

The force resistance structure 26 is sufficiently robust so that it can resist forces applied by the wrench 20 without being damaged in any way. Preferably, it is placed on the strut 12 at an existing location on the strut, so that the tool according to the invention can be used on existing engines without it being necessary to transform them. As illustrated particularly in FIG. 2, this position is for example assured by making the connecting part 28 in the shape of a rectangular or a hoop comprising an approximately U-shaped part for which the two terminal branches are placed on each side of an element of the attachment device 14 fixed to the strut 12, parallel to the longitudinal axis of the engine, and another part containing the said hoop, this other part being installed free to pivot on this U, for example by a ball pin system.

The reaction arm 30 is fixed onto the intermediate arm of the U formed by the connecting part 28, in the immediate vicinity of the bolts 18 to be untightened or tightened. The body of the hydraulic wrench 20 is fixed onto the reaction arm 30, such that the forces resisted by the wrench 20 are transmitted to the reaction arm 30 and then to the connecting part 28, then to the said element of the attachment device 14 and finally to the strut 12.

The above description shows that the tool according to the invention provides optimum safety for the operator and for the engine.

This tool eliminates all risks associated with mechanical tools according to prior art since the operator only needs to put the wrench 12 on the head of the bolt 18, and then to pump using the hydraulic pump 22. Since the force resistance areas are calculated accordingly, the aircraft cannot be damaged in any way.

Furthermore, the tightening or untightening operation may be accomplished by a single operator since the tool is designed such that the wrench is stable and remains in place on the bolt head all by itself.

The operator can determine the torque applied by the wrench 20 on the bolt head 18 at any time by using a nomogram that shows the correspondence between the pressure output by the pump and the torque actually applied by the wrench.

Note that the embodiment that has just been described as an example must not be considered as limiting the scope of the invention to tightening and untightening bolts for fixing engines to struts on aircraft. The tool according to the invention may be used in all cases in which a device has to be tightened or untightened in areas with difficult access requiring application of high torques.

Furthermore, although the use of a manual hydraulic pump is preferred, this manual pump can sometimes be replaced by an automatic pump, without departing from the scope of the invention.

The invention claimed is:

1. A tool for tightening and untightening screwed devices, the tool comprising:

a hydraulic wrench, a hydraulic pump at a distance from the hydraulic wrench, a tube connecting the hydraulic wrench to the pump, and a force resistance structure capable of transmitting wrench reaction forces to a part adjacent to the screwed devices, wherein the force resistance structure comprises a connecting part that can be fixed to the adjacent part and a reaction arm on which the wrench can be fitted, said connecting part includes an approximately U-shaped part with two parallel branches of substantially equal length, a gap between the two branches configured to receive a protrusion of the adjacent part, the two parallel branches being perpendicular to an axis of rotation of the hydraulic wrench, and the connecting part includes a pivot configured to pivot the connecting part with respect to the reaction arm.

2. The tool according to claim 1, in which the hydraulic pump is a manual pump.

3. The tool according to claim 1, wherein the reaction arm is an L-shaped arm having two ends, said hydraulic wrench located proximate a first end of said L-shaped arm and the force resistant structure connected to said reaction arm proximate a second end of the L-shaped member.

4. The tool according to claim 1, wherein the pivot is a ball pin system.

5. The tool according to claim 1, wherein the hydraulic wrench is configured to apply a tightening and untightening torque between 60 daN.m and 90 daN.m.

6. The tool according to claim 1, wherein the hydraulic wrench is inscribed within a 130 mm×60 mm×60 mm parallelepiped.

7. The tool according to claim 1, wherein the hydraulic wrench does not exceed 2 kg.

8. The tool according to claim 1, wherein a precision of the hydraulic wrench is 3% with a repetitiveness of 1%.

* * * * *